US009270069B2

(12) United States Patent
Hammond

(10) Patent No.: US 9,270,069 B2
(45) Date of Patent: Feb. 23, 2016

(54) ANGLED ELECTRICAL CONTACTOR

(71) Applicant: Siemens Industry, Inc., Alpharetta, GA (US)

(72) Inventor: Peter Willard Hammond, Greensburg, PA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 8 days.

(21) Appl. No.: 14/242,961

(22) Filed: Apr. 2, 2014

(65) Prior Publication Data

US 2015/0288122 A1 Oct. 8, 2015

(51) Int. Cl.

| | |
|---|---|
| ***H01R 13/62*** | (2006.01) |
| ***H01R 41/00*** | (2006.01) |
| ***H01R 13/28*** | (2006.01) |

(52) U.S. Cl.

CPC ..... *H01R 41/00* (2013.01); *H01R 13/28* (2013.01)

(58) Field of Classification Search

CPC ..... H01R 13/28

USPC ..... 439/290, 291

See application file for complete search history.

(56) References Cited

U.S. PATENT DOCUMENTS

| | | | | |
|---|---|---|---|---|
| 3,553,633 | A * | 1/1971 | Ondrejka | 439/339 |
| 4,995,824 | A * | 2/1991 | Falco | 439/290 |
| 5,071,363 | A * | 12/1991 | Reylek et al. | 439/291 |
| 5,176,530 | A * | 1/1993 | Reylek et al. | 439/290 |
| 5,664,953 | A * | 9/1997 | Reylek | 439/111 |

* cited by examiner

*Primary Examiner* — Tho D Ta

(57) ABSTRACT

Embodiments of an angled electrical contactor are provided. An aspect includes a moving contact bar including at least 4 contact discs, wherein a first contact disc and a second contact disc of the moving contact bar are located in a first plane, and a third contact disc and a fourth contact disc of the moving contact bar are located in a second plane, wherein the first plane and the second plane are distinct and are at an angle to each other. Another aspect includes a first stationary contact bar including at least 2 contact discs, wherein a first contact disc of first stationary contact bar is in a third plane, the third plane being substantially parallel to the first plane, and a second contact disc of the first stationary contact bar is in a fourth plane, the fourth plane being substantially parallel to the second plane.

20 Claims, 6 Drawing Sheets

ANGLED ELECTRICAL CONTACTOR

BACKGROUND

This disclosure relates generally to electrical contactors, and more specifically to an angled electrical contactor.

Low current electrical contactors may be found in various electrical systems, for example, motor starters. In a prior art low-current electrical contactor 100, an example of which is shown in FIG. 1, a moving contact bar 101 is positioned above a left stationary contact bar 102 and a right stationary contact bar 103. The three contact bars 101, 102, and 103 comprise respective contact discs 105A-B, 104A, and 104B. The contact discs are attached to the contact bars, and positioned so that the contact discs on the stationary contact bars 102 and 103 are directly opposed to corresponding contact discs on the moving contact bar 101. When the moving contact bar 101 is moved down toward the stationary contact bars 102 and 103, contact disc 105A approaches and touches contact disc 104A, and contact disc 105B approaches and touches contact disc 104B, closing a circuit between stationary contact bars 102 and 103 so that a current enters stationary contact bar 102 from current input 108 and flows through moving contact bar 101 to stationary contact bar 103, and exits stationary contact bar 103 via current output 109. The moving contact bar 101 is mechanically driven upwards and downwards by an actuating device 107, which transmits motion to the moving contact bar 101 through a spring 106.

As the moving contact bar 101 is mechanically driven toward the stationary contact bars 102 and 103, one pair of contact discs (e.g., 104A and 105A) may touch before the other pair (e.g., 104B and 105B), due to manufacturing tolerances. Therefore the linkage between the actuating device 107 and the moving contact bar 101 must have some flexibility, so that the contact bar 101 can pivot to cause the second pair of contact discs (e.g., 104B and 105B) to touch. The spring 106 may provide part of this flexibility.

The current is constricted as it flows through the points where the contact disc pairs 104A/105A and 104B/105B touch each other. This constriction generates a magnetic force proportional to the square of the current, which acts to drive the contact discs pairs 104A/105A and 104B/105B apart. This force may be referred to as the blow-apart force. During a fault event in electrical contactor 100, which may be caused by, for example, an external short circuit in the electrical system that contains electrical contactor 100, the currents in electrical contactor 100 may exceed a rated current level of the electrical contactor 100. The current is highly concentrated at each point of contact between the contact disc pairs, which may generate a correspondingly large blow-apart force at the point of contact. The spring 106 and the actuating device 107 must provide a closing force substantially greater than the total blow-apart force during a worst-case fault event. Otherwise, high currents may cause the metal that comprises the contact discs to melt at the point of contact, welding the contacts discs together.

SUMMARY

Embodiments of an angled electrical contactor are provided. An aspect includes a moving contact bar, the moving contact bar comprising at least 4 contact discs, wherein a first contact disc and a second contact disc of the moving contact bar are located in a first plane, and a third contact disc and a fourth contact disc of the moving contact bar are located in a second plane, wherein the first plane and the second plane are distinct and are at an angle to each other. Another aspect includes a first stationary contact bar, the first stationary contact bar comprising at least 2 contact discs, wherein a first contact disc of first stationary contact bar is in a third plane, the third plane being substantially parallel to the first plane, and a second contact disc of the first stationary contact bar is in a fourth plane, the fourth plane being substantially parallel to the second plane.

Embodiments of a method of operating angled electrical contactor are provided. An aspect includes moving a moving contact bar towards a first stationary contact bar, the moving contact bar comprising at least 4 contact discs, wherein a first contact disc and a second contact disc of the moving contact bar are located in a first plane, and a third contact disc and a fourth contact disc of the moving contact bar are located in a second plane, wherein the first plane and the second plane are distinct and are at an angle to each other. Another aspect includes the first stationary contact bar comprising at least 2 contact discs, wherein a first contact disc of first stationary contact bar is in a third plane, the third plane being substantially parallel to the first plane, and a second contact disc of the first stationary contact bar is in a fourth plane, the fourth plane being substantially parallel to the second plane. Another aspect includes based on the moving of the moving contact bar towards the first stationary contact bar, contacting the first contact disc of the moving contact bar to the first contact disc of the first stationary contact bar, and contacting the third contact disc of the moving contact bar to the second contact disc of the first stationary contact bar.

Additional features are realized through the techniques of the present exemplary embodiment. Other embodiments are described in detail herein and are considered a part of what is claimed. For a better understanding of the features of the exemplary embodiment, refer to the description and to the drawings.

BRIEF DESCRIPTION OF THE SEVERAL VIEWS OF THE DRAWINGS

Referring now to the drawings wherein like elements are numbered alike in the several FIGURES.

DETAILED DESCRIPTION

Embodiments of an angled electrical contactor are provided, with exemplary embodiments being discussed below in detail. Electrical contactors that are rated for use in high current applications (for example, above about 500 amperes) may provide more than one parallel path for the current. Dividing the current among two or more parallel paths reduces the blow-apart force, and also reduces the likelihood of a welding event during a fault. Because each path carries only half of the current during a fault event, the blow-apart force per path where the contact discs touch is reduced by a factor of four, and the closing force required from the actuating device and the spring is reduced by a factor of two. For an electrical contactor that includes two parallel paths, the moving contact bar may be made wider to accommodate two contact discs at each end; the stationary contact bar(s) are also made wider to include contact discs corresponding to the contact discs on the moving contact bar. However, achieving good, substantially simultaneous contact between four separate pairs of contact discs in an electrical contactor that comprise flat moving and stationary contact bars may be difficult due to manufacturing tolerances; for example, when three of the contact disc pairs are in contact, it may not be possible to maneuver the moving contact bar so that the fourth contact disc pair comes into contact. Therefore, the moving contact bar may be configured such that the contact discs at each end are at an angle to one another, with the contact discs on the stationary contact bars configured at a corresponding angle. In such an angled configuration, when three of the contact disc pairs are in contact with one another, it is still possible to maneuver the moving contact bar so that the fourth contact disc pair comes into contact.

Figure 1:
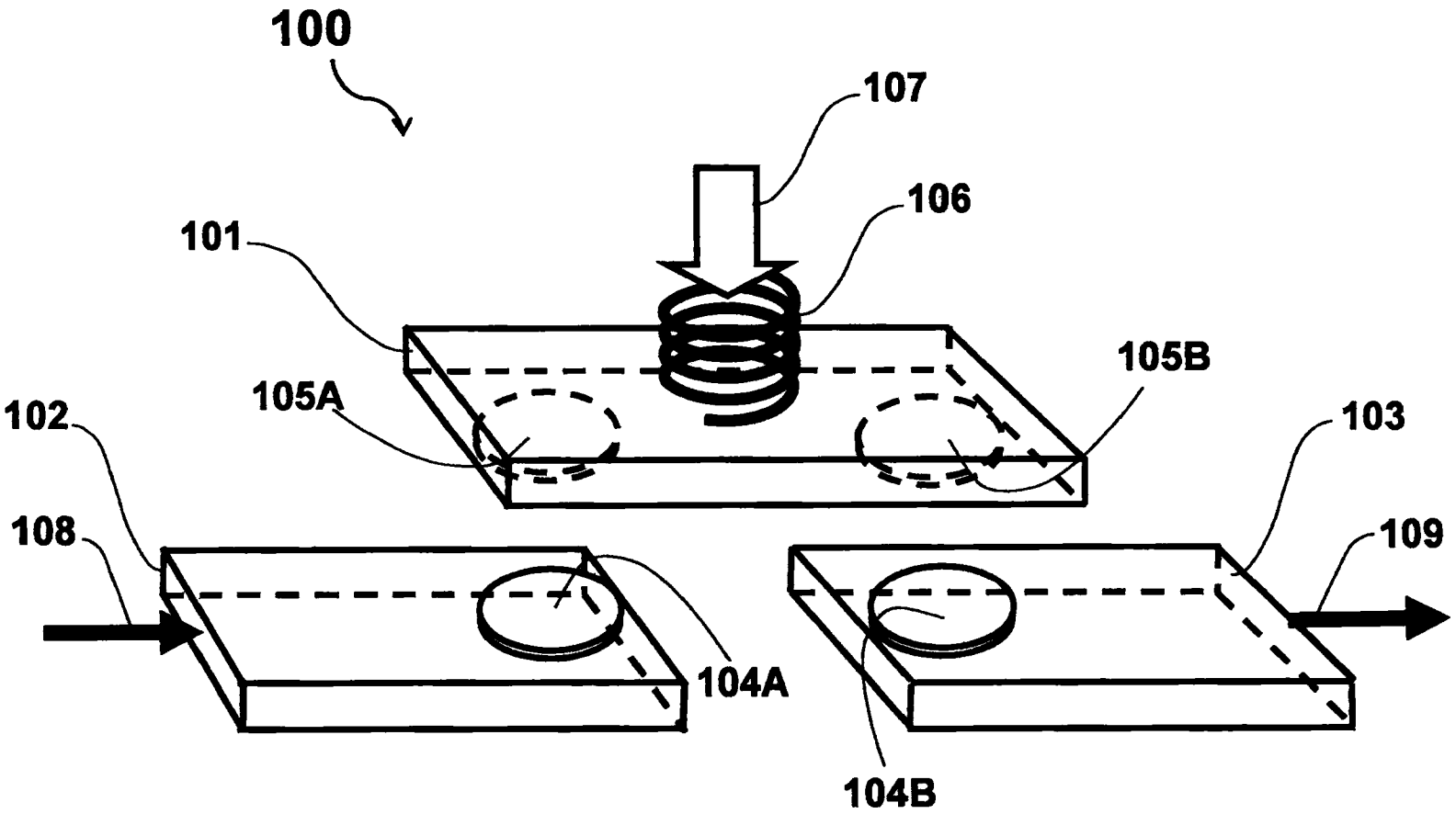
FIG. 1 PRIOR ART
FIG. 1 illustrates an embodiment of a prior art electrical contactor.
Figure 2A:
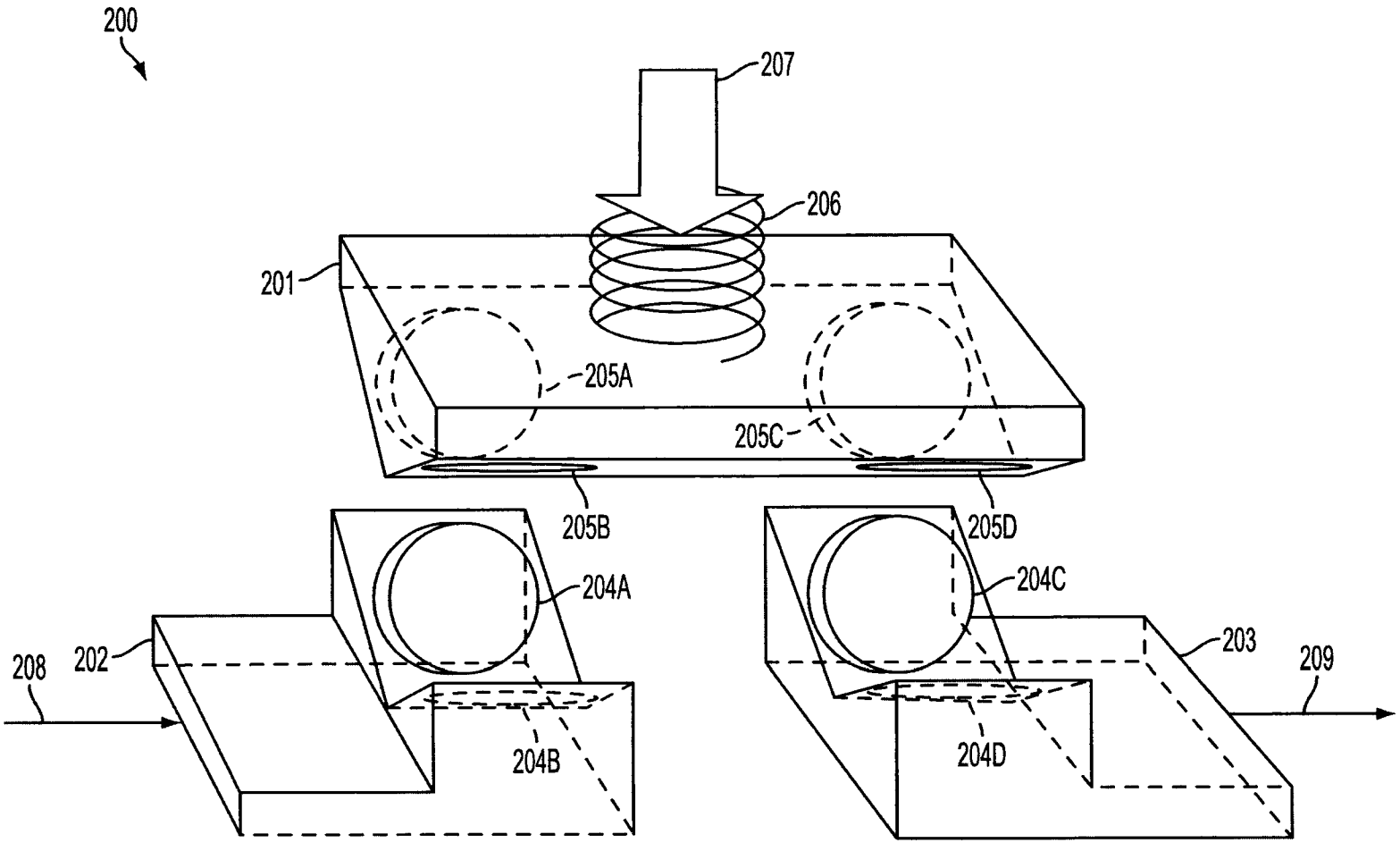
FIG. 2A illustrates an embodiment of an angled electrical contactor.

FIG. 2A shows an embodiment of an angled electrical contactor 200. The angled electrical contactor 200 comprises a moving contact bar 201 that is moved towards and away from stationary contact bars 102 and 103 by an actuating device 207 and a spring 206. The angled electrical contactor 200 provides two parallel current paths; the first through contact disc pairs 205A/204A and 205C/204C, and the second through contact discs pairs 205B/204B and 205D/204D. The four contact discs 205A-D on the moving contact bar 201 are not all in the same plane; rather, contact discs 205A and 205C are in a first plane, and contact discs 205B and 205D are in a second plane that is at an angle to the first plane. The two stationary contact bars 202 and 203 also have their respective contact discs 204A-D arranged in two planes that are at an angle to each other corresponding to the angle between the first and second planes on the moving contact bar 201; e.g., contact disc 204A and contact disc 204C are in a third plane that is substantially parallel to the first plane, and contact disc 204B and contact disc 204D are in a fourth plane that is substantially parallel to the second plane. The actuating device 207 moves the moving contact bar 201 via spring 206 upwards to put the angled electrical contactor 200 in the off position, and downwards to put the angled electrical contactor 200 in the on position. When the angled electrical contactor 200 is in the on position, current is input to the angled electrical contactor 200 via stationary contact bar 202 via current input 208, flows through from stationary contact bar 202 to moving contact bar 201 via contact discs 204A-B and 205A-B, from moving contact bar 201 to stationary contact bar 203 via contact discs 204C-D and 205C-D, and out of stationary contact bar 203 via current output 209. Angled electrical contactor 200 allows the moving contact bar 201 to move in four degrees of freedom (vertical, roll, pitch, and yaw), to achieve good contact between the contact discs 205A-D on moving contact bar 201 and contact discs 204A-D on stationary contact bars 202 and 203. Even if manufacturing tolerances prevent all four disc pairs from touching on the initial descent, there are three degrees of freedom remaining for moving contact bar 201 to move to allow all remaining disc pairs to touch. The moving contact bar 201 may have some flexibility, so that the contact bar 201 can pivot to utilize roll, pitch, and yaw movement. In some embodiments, a plurality of springs may be included in an angled electrical contactor instead of the single spring 206 shown in FIG. 2.

The actuating device 207 provides the holding force between the moving contact bar 201 and stationary contact bars 202 and 203 when the angled electrical contactor is in the on position (i.e., is conducting current), and may be any appropriate actuating mechanism, for example, an electric solenoid, a manually operated lever, a cam and roller, or a pneumatic cylinder, in various embodiments. The actuating device 207 may travel a fixed distance, somewhat greater than the separation between the moving contact bar 201 and the stationary contact bars 202 and 203. The excess travel acts to compress the spring 206, which is dimensioned to provide a holding force on the moving contact bar 201. Each of the four contact discs 205A-D is therefore pressed against the opposing contact discs 204A-D with more than one-fourth of the holding force from the spring 206. As will be described below, the total force between the opposing contact discs is greater than the holding force. The contact bars 201-203 may be made from a metal with a relatively low electrical resistance, such as copper, in some embodiments. The contact discs 204A-D and 205A-D may be made from a metal that resists tarnishing, such as silver or cadmium, in some embodiments. In other embodiments, the contact discs 204A-D and 205A-D may be made from a metal with a relatively high melting point, such as tungsten.

Figure 2B:
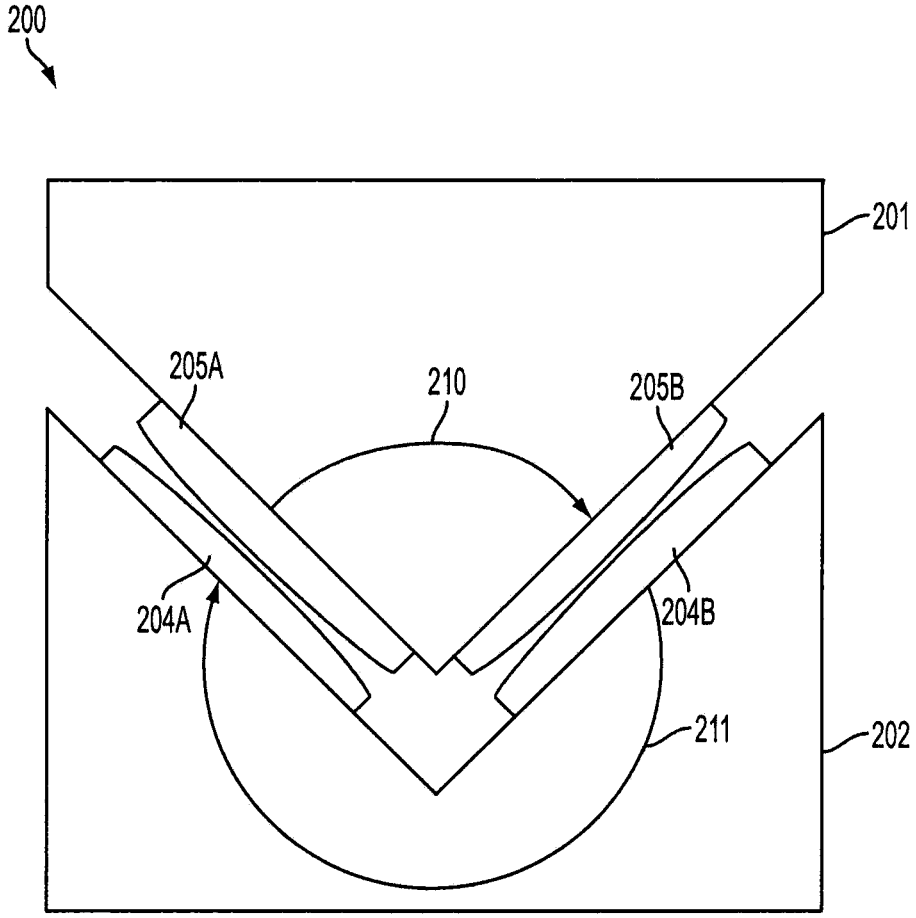
FIG. 2B illustrates a side view of the angled electrical contactor of FIG. 2A.

FIG. 2B shows a side view of the angled electrical contactor 200 that shows the points where the contact discs 204A and 205A on moving contact bar 201, and contact discs 204B and 205B on stationary contact bar 202, contact each other when the angled electrical contactor 200 is conducting current. The contact discs 204A-B and 205A-B as shown in FIG. 2 have a slightly domed or convex surface, which causes the contact point to be near the center of the discs. Angle 210 is the angle between the plane surface containing contact disc 205A and the place surface containing contact disc 205B on the moving contact bar 201. Angle 210 is shown as 90° degrees in FIG. 4B, but in various embodiments, angle 210 may be any angle that is greater than 0° but less than 180°. In some embodiments, angle 210 is between about 60° and 120°. On stationary contact bar 202, contact disc 204A is in a plane that is at an angle 211 with respect to the plane containing contact disc 204B. Angle 211 corresponds to angle 210 and is approximately equal to 360° minus angle 210. In an embodiment in which angle 210 is about 90°, the moving contact bar 201 must travel about 41% farther, as compared to an embodiment comprising flat moving and stationary contact bars, to achieve the same contact gap when the angled electrical contactor 200 is in the off position. However, the total closing force between the contact discs 204A-D and 205A-D is 41% greater than the force from spring 206 in such an embodiment, due to the wedging effect. This increased closing force improves the ability of the angled electrical contactor 200 to avoid welding. In embodiments in which the angle 210 is more acute, the extra travel that is required and the extra force that is generated both increase. Further embodiments of angled electrical contactors that incorporate a moving contact bar that is angled similarly to moving contact bar 201 of FIGS. 2A-B, and one or more stationary contact bars that are angled similarly to stationary contact bars 202-203, are discussed below with respect to FIGS. 3-5.

Figure 3:
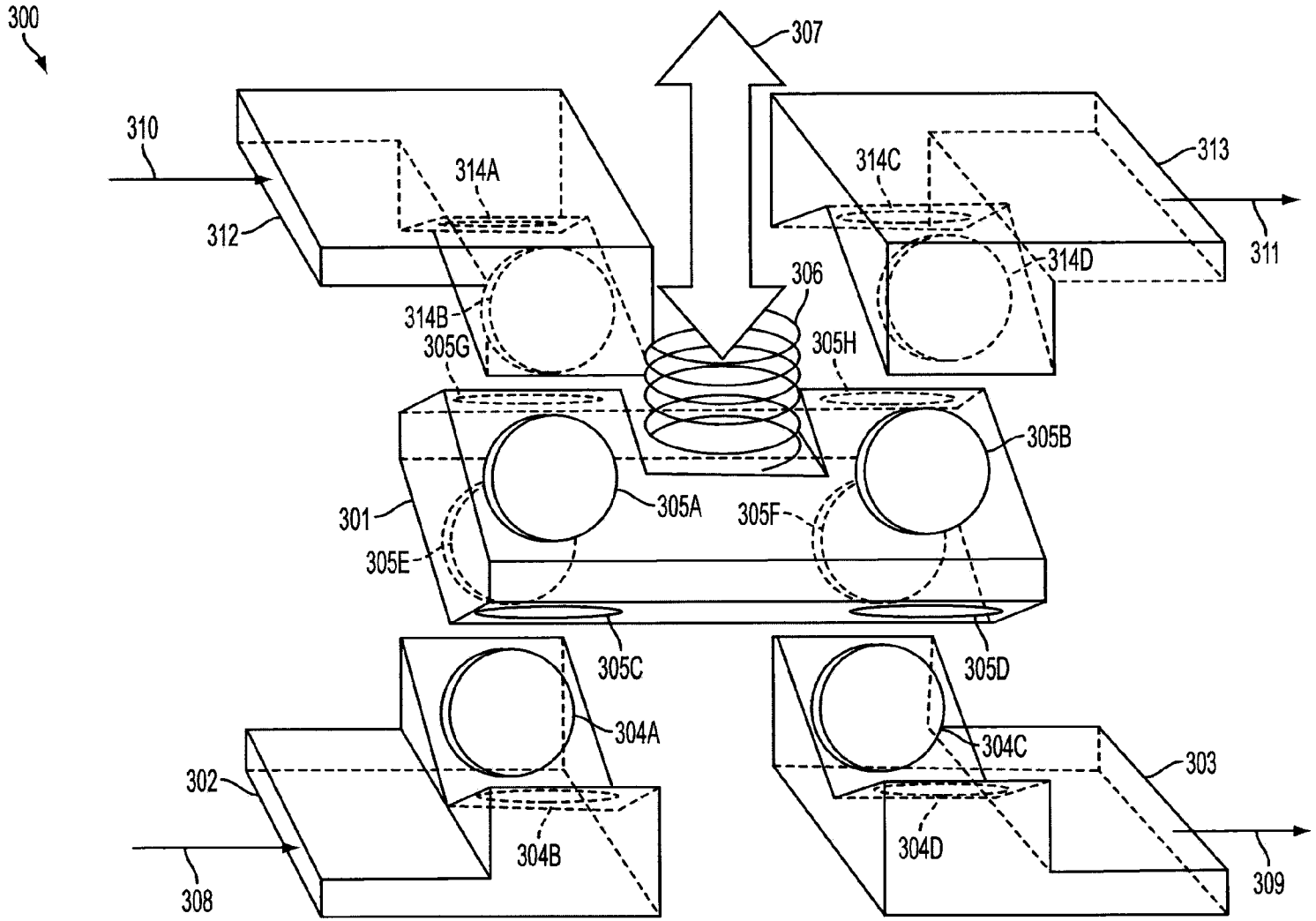
FIG. 3 illustrates an embodiment of a single-pole double-throw contactor comprising an angled electrical contactor.

FIG. 3 illustrates an embodiment of a single-pole double-throw contactor 300 comprising an angled electrical contactor as shown in FIGS. 2A-B. In single-pole double-throw contactor 300 there are four stationary contact bars, 302 and 303 below, and 312 and 313 above. The moving contact bar 301 has four separate plane surfaces, each plane surface comprising two respective contact discs of contact discs 305A-H. A first plane containing contact discs 305A-B is at an angle with respect to a second plane containing contact discs 305G-H; a third plane containing contact discs 305C-D is at approximately the same angle with respect to a fourth plane containing contact discs 305E-F. The first and third planes are substantially parallel, as are the second and fourth planes. The four stationary contact bars 302, 303, 312, and 313 each have two respective contact discs 304A-B, 304C-D, and 314A-B, and 314C-D; on each stationary contact bar 302, 303, 312, and 313, the contact discs are mounted on two different planes that are substantially parallel to the plane surfaces of the moving contact bar 301 that contact the particular stationary contact bar. When the actuating device 307 drives the moving contact bar 301 downwards via spring 306 towards stationary contact bars 302 and 303, the moving contact bar 301 closes the circuit between stationary contact bars 302 and 303, and current flows from current input 308 through stationary contact bars 302 and 303 via moving contact bar 301, through contacts discs 304A-D and contact discs 305C-F, to current output 309. When the actuating device 307 drives the moving contact bar 301 upwards via spring 306 towards stationary contact bars 312 and 313, the moving contact bar 301 closes the circuit between stationary contact bars 312 and 313, and current flows from current input 310 through stationary contact bars 312 and 313 via moving contact bar 301, through contacts discs 314A-D and contact discs 305A-B and 305G-H, to current output 311. In embodiments of a single-pole double-throw contactor 300, the actuating device 307 is configured to be capable of generating the same amount force in both the downwards and upwards directions.

Figure 4:
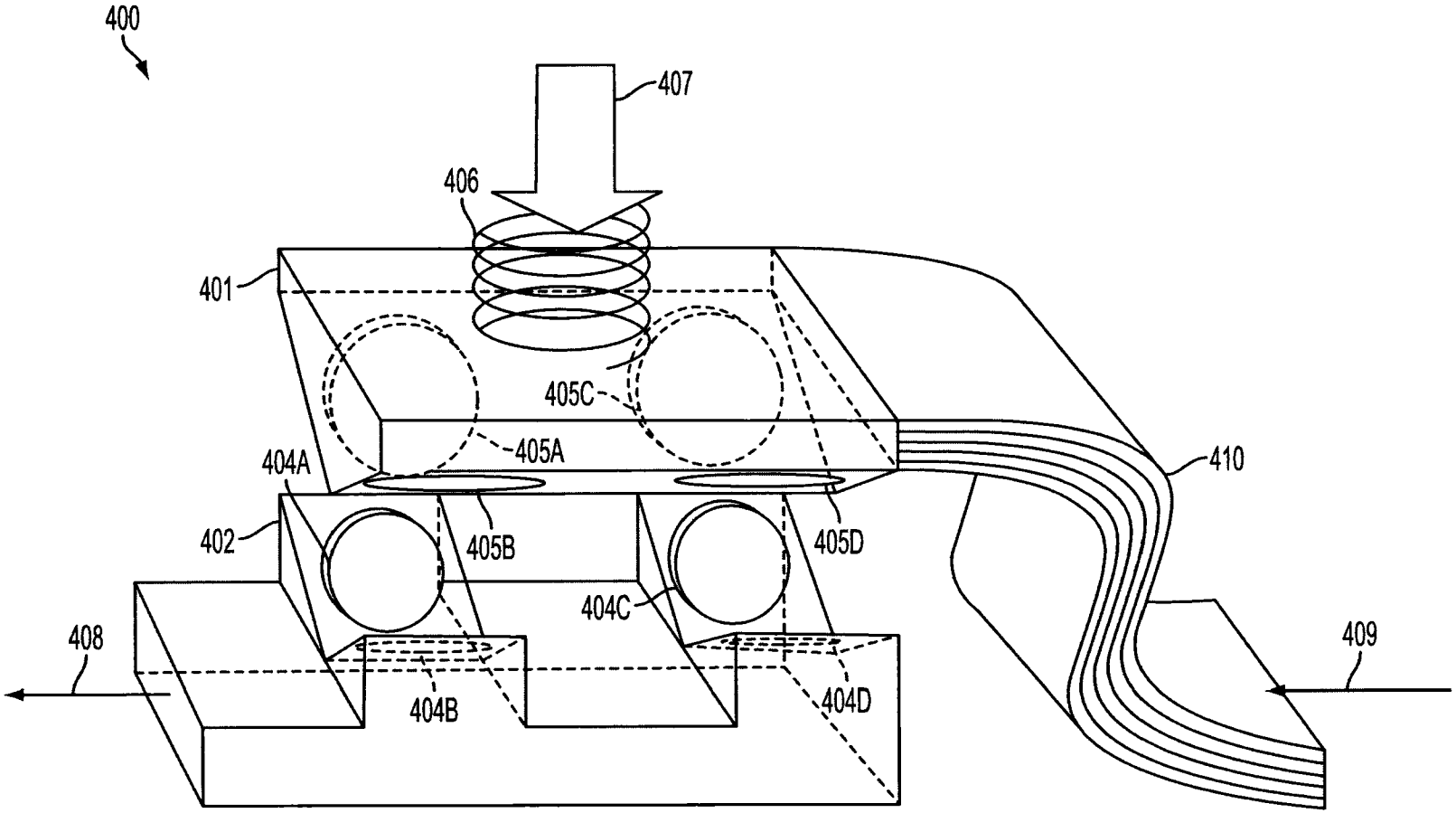
FIG. 4 illustrates another embodiment of an angled electrical contactor.

FIG. 4 shows another embodiment of an angled electrical contactor 400. The angled electrical contactor 400 comprises a moving contact bar 401 moved upwards and downwards by actuating device 407 and spring 406. The angled electrical contactor 400 provides four parallel current paths; the first through contact disc pair 404A/405A, the second through contact disc pair 404B/405B, the third through contact disc pair 404C/405C, and the fourth through contact disc pair 404D/405D. The four contact discs 405A-D on the moving contact bar 401 are not all in the same plane; rather, contact discs 405A and 405C are in a first plane, and contact discs 405B and 405D are in a second plane that is at an angle to the first plane. The stationary contact bar 402 also has contact discs 404A-D arranged in two planes that are at an angle to each other that corresponds to the angle of the contacts discs 405A-D on the moving contact bar 401. The actuating device 407 moves the moving contact bar 401 upwards via the spring 406 to put the angled electrical contactor 400 in the off position, and downwards to put the angled electrical contactor 400 in the on position. Flexible conductor 410 inputs current to the angled electrical contactor 400. When the angled electrical contactor 400 is in the on position, current is input to the angled electrical contactor 400 via moving contact bar 401 via current input 409 and flexible conductor 410, flows through moving contact bar 401 to the stationary contact bar 402 via contact discs 404A-D and 405A-D, and out current output 408. FIG. 4 is shown for illustrative purposes only; in some embodiments, current may be input to the stationary contact bar, and output by the moving contact bar.

Figure 5:
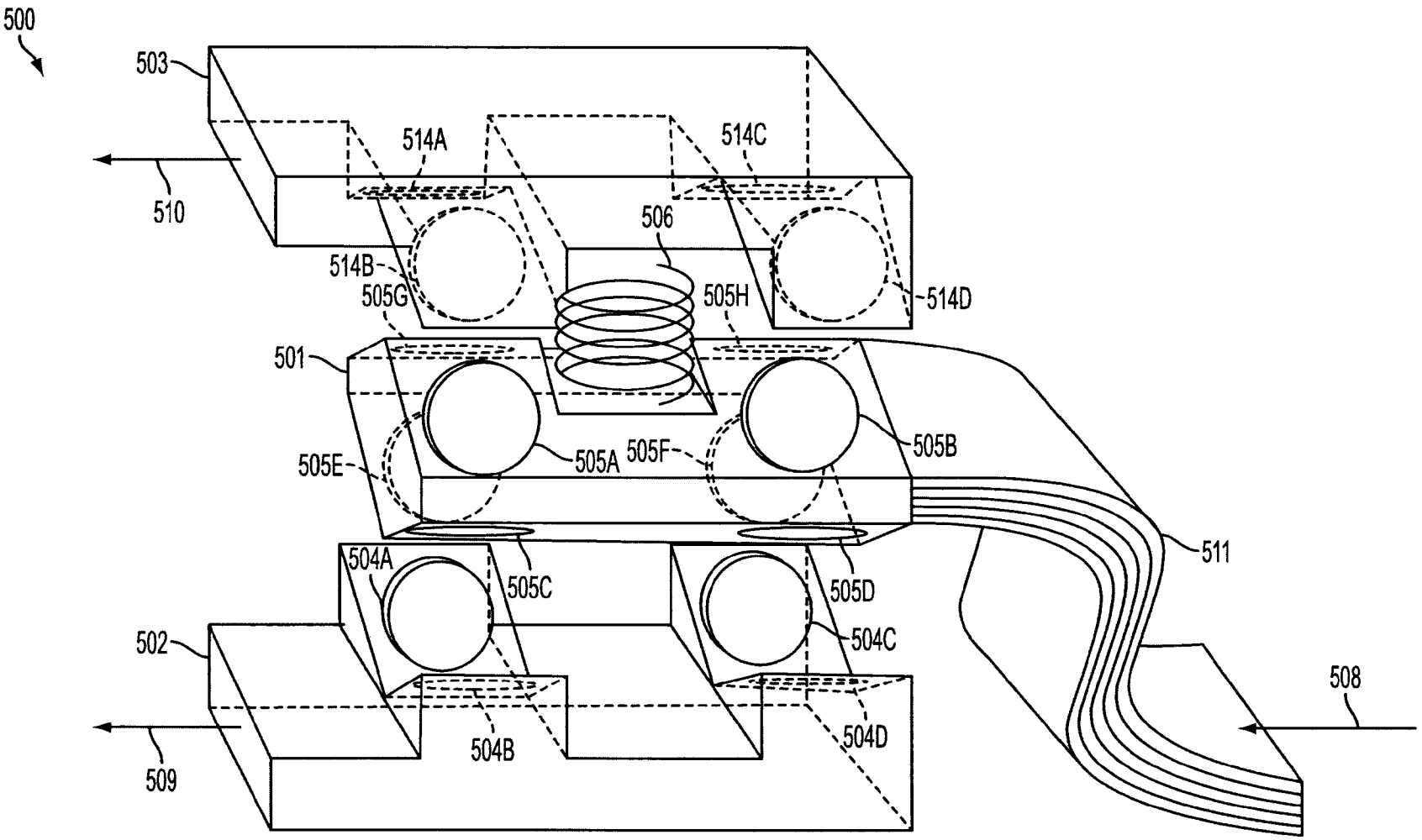
FIG. 5 illustrates an embodiment of a single-pole double-throw contactor comprising an angled electrical contactor.

FIG. 5 illustrates an embodiment of a single-pole double-throw contactor 500 comprising an angled electrical contactor as shown in FIG. 4. In single-pole double-throw contactor 500 there are two stationary contact bars, 502 below, and 503 above. The moving contact bar 501 has four separate plane surfaces, each plane surface comprising two respective contact discs of contact discs 505A-H. A first plane containing contact discs 505A-B is at an angle with respect to a second plane containing contact discs 505G-H; a third plane containing contact discs 505C-D is at approximately the same angle with respect to a fourth plane containing contact discs 505E-F. The two stationary contact bars 502 and 503 each have four respective contact discs 504A-D and 514A-D on each stationary contact bar, the contact discs are mounted on two planes are at an angle that corresponds to the above-listed planes on moving contact bar 501. Moving contact bar 501 is moved upwards and downwards via spring 506 and an actuating device such as actuating device 307 that was shown in FIG. 3. Flexible conductor 511 supplies current to the single-pole double-throw contactor 500. When the actuating device drives the moving contact bar 501 downwards via spring 506, the moving contact bar 501 comes into contact with stationary contact bar 502, and current flows from current input 508 and flexible conductor 511 through moving contact bar 501, through contacts discs 505C-F and contact discs 504A-D to stationary contact bar 502, and out at current output 509. When the actuating device moves the moving contact bar 501 upwards via spring 506, the moving contact bar 501 comes into contact with stationary contact bar 503, and current flows from current input 508 and flexible conductor 511 through moving contact bar 501, through contact discs 505A-B and 505G-H to contacts discs 514A-D to stationary contact bar 503, and out at current output 510. FIG. 5 is shown for illustrative purposes only; in some embodiments, current may be input to the stationary contact bars, and output from the moving contact bar via the flexible conductor.

The technical effects and benefits of exemplary embodiments include provision of parallel current paths and good, substantially simultaneous electrical contact in an electrical contactor. In some embodiments, the total closing force on all pairs of contact discs exceeds the force applied by the actuating device and the spring.

The terminology used herein is for the purpose of describing particular embodiments only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An angled electrical contactor, comprising:

a moving contact bar, the moving contact bar comprising at least 4 contact discs, wherein a first contact disc and a second contact disc of the moving contact bar are located in a first plane, and a third contact disc and a fourth contact disc of the moving contact bar are located in a second plane, wherein the first plane and the second plane are distinct and are at an angle to each other;

a first stationary contact bar, the first stationary contact bar comprising at least 2 contact discs, wherein a first contact disc of first stationary contact bar is in a third plane, the third plane being substantially parallel to the first plane, and a second contact disc of the first stationary contact bar is in a fourth plane, the fourth plane being substantially parallel to the second plane; and an actuating device moving the moving contact bar via a spring towards and away from the first stationary contact bar.

2. The angled electrical contactor of claim 1, wherein the angle is between about 1° and about 179°.

3. The angled electrical contactor of claim 2, wherein the angle is between about 60° and about 120°.

4. The angled electrical contactor of claim 1, further comprising a second stationary contact bar, the second stationary contact bar comprising at least 2 contact discs, wherein a first contact disc of the second stationary contact bar is in the third plane, and a second contact disc of the second stationary contact bar is in the fourth plane.

5. The angled electrical contactor of claim 4, wherein the moving contact bar is configured to move towards and away from the first stationary contact bar and the second stationary contact bar by the actuating device, wherein the first contact disc of the moving contact bar is configured to contact the first contact disc of the first stationary contact bar, wherein the second contact disc of the moving contact bar is configured to contact the second contact disc of the first stationary contact bar, wherein the third contact disc of the moving contact bar is configured to contact the first contact disc of the second stationary contact bar, and wherein the fourth contact disc of the moving contact bar is configured to contact the second contact disc of the second stationary contact bar such that a current flows through the angled electrical contactor through the first stationary contact bar, the moving contact bar, and the second stationary contact bar.

6. The angled electrical contactor of claim 5, further comprising a first current input on the first stationary contact bar, and a first current output on the second stationary contact bar.

7. The angled electrical contactor of claim 4, wherein the angled electrical contactor comprises a single-pole double-throw contactor, wherein the moving contact bar comprises at least 8 contact discs, wherein a fifth contact disc and a sixth contact disc of the moving contact bar are located in a fifth plane, and a seventh contact disc and an eighth contact disc of the moving contact bar are located in a sixth plane, wherein the fifth plane and the sixth plane are distinct and are at an angle to each other.

8. The angled electrical contactor of claim 7, further comprising:

a third stationary contact bar, the third stationary contact bar comprising at least 2 contact discs, wherein a first contact disc of third stationary contact bar is in a seventh plane, the seventh plane being substantially parallel to the fifth plane, and a second contact disc of the third stationary contact bar is in a eighth plane, the eighth plane being substantially parallel to the sixth plane; and a fourth stationary contact bar, the fourth stationary contact bar comprising at least 2 contact discs, wherein a first contact disc of the fourth stationary contact bar is in the seventh plane, and a second contact disc of the fourth stationary contact bar is in the eighth plane.

9. The angled electrical contactor of claim 8, wherein the moving contact bar is configured to move towards and away from the first stationary contact bar and the second stationary contact bar by the actuating device, wherein the fifth contact disc of the moving contact bar is configured to contact the first contact disc of the third stationary contact bar, wherein the sixth contact disc of the moving contact bar is configured to contact the second contact disc of the third stationary contact bar, wherein the seventh contact disc of the moving contact bar is configured to contact the first contact disc of the fourth stationary contact bar, and wherein the eighth contact disc of the moving contact bar is configured to contact the second contact disc of the fourth stationary contact bar such that a current flows through the angled electrical contactor through the third stationary contact bar, the moving contact bar, and the fourth stationary contact bar.

10. The angled electrical contactor of claim 9, further comprising a first current input on the first stationary contact bar, and a first current output on the second stationary contact bar, a second current input on the third stationary contact bar, and a second current output on the fourth stationary contact bar.

11. The angled electrical contactor of claim 1, wherein the first stationary contact bar comprises at least 4 contact discs, and wherein a third contact disc of the first stationary contact bar is in the third plane, and a second contact disc of the first stationary contact bar is in the fourth plane.

12. The angled electrical contactor of claim 11, wherein the moving contact bar is configured to move towards and away from the first stationary contact bar by the actuating device, wherein the first contact disc of the moving contact bar is configured to contact the first contact disc of the first stationary contact bar, wherein the second contact disc of the moving contact bar is configured to contact the second contact disc of the first stationary contact bar, wherein the third contact disc of the moving contact bar is configured to contact the third contact disc of the first stationary contact bar, and wherein the fourth contact disc of the moving contact bar is configured to contact the fourth contact disc of the first stationary contact bar such that a current flows through the angled electrical contactor through the first stationary contact bar and the moving contact bar.

13. The angled electrical contactor of claim 12, further comprising a current input comprising a flexible conductor connected to the moving contact bar, and a first current output on the first stationary contact bar.

14. The angled electrical contactor of claim 11, wherein the angled electrical contactor comprises a single-pole double-throw contactor, wherein the moving contact bar comprises at least 8 contact discs, wherein a fifth contact disc and a sixth contact disc of the moving contact bar are located in a fifth plane, and a seventh contact disc and an eighth contact disc of the moving contact bar are located in a sixth plane, wherein the fifth plane is substantially parallel to the first plane, and the sixth plane is substantially parallel to the second plane.

15. The angled electrical contactor of claim 14, further comprising:

a second stationary contact bar, the second stationary contact bar comprising at least 4 contact discs, wherein a first contact disc and a second contact disc of second stationary contact bar are in a seventh plane, the seventh plane being substantially parallel to the fifth plane, and a third contact disc and a fourth contact disc of the second stationary contact bar are in a eighth plane, the eighth plane being substantially parallel to the sixth plane.

16. The angled electrical contactor of claim 15, wherein the moving contact bar is configured to move towards and away from the second stationary contact bar by the actuating device, wherein the fifth contact disc of the moving contact bar is configured to contact the first contact disc of the second stationary contact bar, wherein the sixth contact disc of the moving contact bar is configured to contact the second contact disc of the second stationary contact bar, wherein the seventh contact disc of the moving contact bar is configured to contact the third contact disc of the second stationary contact bar, and wherein the eighth contact disc of the moving contact bar is configured to contact the fourth contact disc of the second stationary contact bar such that a current flows through the angled electrical contactor through the second stationary contact bar and the moving contact bar.

17. The angled electrical contactor of claim 16, further comprising a current input comprising a flexible conductor connected to the moving contact bar, a first current output on the first stationary contact bar, and a second current output on the second stationary contact bar.

18. A method of operating angled electrical contactor, comprising:

moving a moving contact bar towards a first stationary contact bar by an actuating device and a spring, the moving contact bar comprising at least 4 contact discs, wherein a first contact disc and a second contact disc of the moving contact bar are located in a first plane, and a third contact disc and a fourth contact disc of the moving contact bar are located in a second plane, wherein the first plane and the second plane are distinct and are at an angle to each other;

the first stationary contact bar comprising at least 2 contact discs, wherein a first contact disc of first stationary contact bar is in a third plane, the third plane being substantially parallel to the first plane, and a second contact disc of the first stationary contact bar is in a fourth plane, the fourth plane being substantially parallel to the second plane;

based on the moving of the moving contact bar towards the first stationary contact bar, contacting the first contact disc of the moving contact bar to the first contact disc of the first stationary contact bar, and contacting the third contact disc of the moving contact bar to the second contact disc of the first stationary contact bar.

19. The method of claim 18, wherein the angle is between about 1° and about 179°.

20. The angled electrical contactor of claim 19, wherein the angle is between about 60° and about 120°.

* * * * *